US011015236B2

(12) United States Patent
Bertheville et al.

(10) Patent No.: US 11,015,236 B2
(45) Date of Patent: May 25, 2021

(54) POWDER METALLURGY MOULDING COMPOSITION NOTABLY INTENDED FOR MANUFACTURING DECORATIVE OR COVERING ARTICLES IN SINTERED MASSIVE CERMET AND SAID DECORATIVE OR COVERING ARTICLES IN SINTERED MASSIVE CERMET

(71) Applicant: The Swatch Group Research and Development Ltd, Marin (CH)

(72) Inventors: Bernard Bertheville, Sion (CH); Yann Fallet, Savagnier (CH); Jakob Kubarsepp, Tallinn (EE); Mart Kolnes, Tallinn (EE); Lauri Kollo, Tallinn (EE)

(73) Assignee: The Swatch Group Research and Development Ltd, Marin (CH)

( * ) Notice: Subject to any disclaimer, the term of this patent is extended or adjusted under 35 U.S.C. 154(b) by 146 days.

(21) Appl. No.: 16/140,868

(22) Filed: Sep. 25, 2018

(65) Prior Publication Data

US 2019/0136352 A1 May 9, 2019

(30) Foreign Application Priority Data

Nov. 8, 2017 (EP) ..... 17200647

(51) Int. Cl.

| | |
|---|---|
| ***C22C 29/02*** | (2006.01) |
| ***C22C 29/04*** | (2006.01) |
| ***C22C 29/16*** | (2006.01) |
| ***B22F 3/10*** | (2006.01) |
| ***B22F 5/00*** | (2006.01) |
| ***B44F 9/10*** | (2006.01) |
| ***G04B 29/02*** | (2006.01) |
| ***G04B 45/00*** | (2006.01) |
| ***C22C 38/22*** | (2006.01) |
| ***C22C 38/26*** | (2006.01) |
| ***C22C 38/02*** | (2006.01) |
| ***G04B 37/22*** | (2006.01) |
| ***C22C 38/32*** | (2006.01) |
| *B22F 1/00* | (2006.01) |
| *C22C 29/10* | (2006.01) |
| *C22C 1/10* | (2006.01) |
| *C22C 33/02* | (2006.01) |

(52) U.S. Cl.

CPC ..... *C22C 29/02* (2013.01); *B44F 9/10* (2013.01); *C22C 38/02* (2013.01); *C22C 38/22* (2013.01); *C22C 38/26* (2013.01); *C22C 38/32* (2013.01); *G04B 29/027* (2013.01); *G04B 37/22* (2013.01); *G04B 45/0076* (2013.01); *B22F 1/0059* (2013.01); *B22F 3/1021* (2013.01); *B22F 5/00* (2013.01); *B22F 2301/35* (2013.01); *B22F 2302/10* (2013.01); *B22F 2998/10* (2013.01); *C22C 1/1084* (2013.01); *C22C 29/04* (2013.01); *C22C 29/10* (2013.01); *C22C 29/16* (2013.01); *C22C 33/0242* (2013.01); *C22C 33/0285* (2013.01); *C22C 33/0292* (2013.01)

(58) Field of Classification Search

None

See application file for complete search history.

(56) References Cited

U.S. PATENT DOCUMENTS

| | | | | |
|---|---|---|---|---|
| 3,725,016 | A | 4/1973 | Mal et al. | |
| 4,615,734 | A * | 10/1986 | Spriggs | B22F 3/15 106/403 |
| 4,904,445 | A * | 2/1990 | Iyori | C22C 29/02 419/10 |
| 6,641,640 | B1 | 11/2003 | Hesse et al. | |
| 2014/0336034 | A1* | 11/2014 | Cartier | B01F 7/20 501/93 |
| 2017/0043426 | A1* | 2/2017 | Fiala | C22C 38/002 |

OTHER PUBLICATIONS

European Search Report dated May 8, 2018 in European Application 17200647.0, filed on Nov. 8, 2017 (with English Translation of Categories of cited documents).

Combined Chinese Office Action and Search Report dated Aug. 19, 2020 in corresponding Chinese Patent Application No. 201811324644.0 (with English Translation of Category of Cited Documents), 8 pages.

* cited by examiner

*Primary Examiner* — George Wyszomierski

(74) *Attorney, Agent, or Firm* — Oblon, McClelland, Maier & Neustadt, L.L.P.

(57) ABSTRACT

A powder metallurgy moulding composition intended for manufacturing decorative or covering articles in sintered massive cermet, including an inorganic powder to form the cermet and an organic binder. The inorganic powder includes by weight of 35% to 95% of at least one ceramic phase based on ceramic selected from the group consisting of TiC, TiCN, TiN and mixtures thereof, and from 5% to 65% of a metallic phase, the metallic phase consisting by weight of at least 40% of iron, from 15% to 45% of chromium, from 0.1% to 25% of molybdenum, from 0.1% to 10% of silicon, from 0 to 10% of boron, and from 0 to 10% of niobium, the respective amounts of the elements of the metallic phase being such that their sum is equal to 100 wt % of the metallic phase.

21 Claims, No Drawings

POWDER METALLURGY MOULDING COMPOSITION NOTABLY INTENDED FOR MANUFACTURING DECORATIVE OR COVERING ARTICLES IN SINTERED MASSIVE CERMET AND SAID DECORATIVE OR COVERING ARTICLES IN SINTERED MASSIVE CERMET

This application claims priority from European patent application No. 17200647.0 filed on Nov. 8, 2017, the entire disclosure of which is hereby incorporated herein by reference.

FIELD OF THE INVENTION

The invention relates to a powder metallurgy moulding composition intended for manufacturing articles in sintered massive cermet, notably decorative or covering articles, comprising an inorganic powder intended to form the cermet, and an organic binder. The present invention also relates to a decorative or covering article and an element of a clock or watch movement in sintered massive cermet produced starting from said moulding composition as well as a method based on powder metallurgy for manufacturing an article in sintered massive cermet.

BACKGROUND OF THE INVENTION

Ceramic-metal composite materials, called cermets, are used in the manufacture of hard materials for making timepiece or jewelry components, or decorative components for portable electronics (tablets, telephones, etc.). These composite materials comprise a ceramic phase and a metallic phase or metallic binder. Massive cermets are obtained by powder metallurgy using methods of pressing or injection, followed by sintering, starting from a moulding composition comprising an organic binder and an inorganic powder.

More specifically, the complete process for manufacturing an article in massive cermet by powder metallurgy comprises at least the following steps:

- preparing the raw materials of the inorganic powder;
- granulation;
- mixing with an organic binder to obtain the moulding composition or feedstock;
- pressing or injecting an amount of the feedstock obtained, notably in a moulding chamber, for making a blank of the article, called a "green compact". Injection is carried out under pressure, notably in a screw injector comprising means for heating this feedstock to the required temperature;
- binder-removal stoving for burning away and/or dissolving certain components of the organic binder to obtain a brown compact;
- thermal treatment (sintering) of the blank or brown compact after binder removal, giving the dense massive cermet article obtained its final coherence. This thermal treatment leads to dimensional shrinkage, giving an article with the finished dimensions;
- finishing treatment for the final appearance of the article (machining and/or polishing).

In timepiece coverings, massive cermets based on TiC, TiCN or TiN are used on account of their characteristics of scratch resistance (high hardness), metallic luster after polishing approaching that of steels and stainless steels (if based on TiC and TiCN) and low densities, approaching those of ceramics. These cermets show excellent resistance to salt water corrosion. However, they have the drawback that they all use nickel or cobalt as the metallic binder and therefore display appreciable rates of release of nickel or cobalt, which may sometimes exceed the maximum permitted rate (0.280 $\mu g/cm^2 \cdot week$ according to the current RoHS and REACH standards).

For applications in watchmaking, jewelry-making and portable electronics, and especially for ornamental elements in contact with the human skin, a material of the cermet type must guarantee absolute absence of release of allergenic elements. The alternative metallic binders proposed to date by manufacturers active in the field of cermets based on TiC, TiCN or TiN are mainly iron (Fe), iron-chromium (Fe—Cr) and iron-chromium-molybdenum (Fe—Cr—Mo), stainless steels and heat-resistant steels.

Moreover, applied to a decorative element in watchmaking, all these cermets have very low corrosion resistance on immersion in a saline medium as well as under salt spray, notably after undergoing steps of machining of terminations (mechanical, laser) and/or polishing.

Applied to an element of a clock movement, these cermets are interesting because of their great hardness, but their low corrosion resistance is detrimental if there is condensation inside the clock movement or for covering components in contact with the wearer's sweat.

SUMMARY OF THE INVENTION

The aim of the present invention is to rectify these drawbacks by proposing a powder metallurgy moulding composition making it possible to manufacture articles, notably decorative or covering articles, in sintered massive cermet not comprising allergenic elements such as nickel and/or cobalt, used traditionally.

Another aim of the present invention is to propose a powder metallurgy moulding composition making it possible to manufacture articles, notably decorative or covering articles and elements of clock movements, in sintered massive cermet with high corrosion resistance on immersion in a saline medium and under salt spray.

Another aim of the present invention is to propose a powder metallurgy moulding composition further displaying the same properties of hardness, toughness, density, luster, and hues as the commercially available cermets for manufacture of decorative or covering articles in the fields of watchmaking, jewelry-making, or portable electronics.

For this purpose, the invention relates firstly to a powder metallurgy moulding composition intended for manufacturing articles in sintered massive cermet, comprising an inorganic powder intended to form the cermet and an organic binder.

According to the invention, said inorganic powder consists by weight of 35% to 95% of at least one ceramic phase based on ceramic selected from the group consisting of TiC, TiCN, TiN and mixtures thereof, and from 5% to 65% of a metallic phase, said metallic phase consisting by weight of at least 40% of iron, from 15% to 45% of chromium, from 0.1% to 25% of molybdenum, from 0.1% to 10% of silicon, from 0 to 10% of boron, and from 0 to 10% of niobium, the respective amounts of the elements of the metallic phase being such that their sum is equal to 100 wt % of the metallic phase.

A moulding composition of this kind makes it possible to obtain articles in sintered massive cermet without an allergenic element such as nickel and/or cobalt, and with high resistance to saline corrosion. Said article may be for example a decorative or covering article or an element of a clock movement.

The present invention also relates to a method based on powder metallurgy for manufacturing an article in sintered massive cermet comprising a step of preparing a moulding composition as defined above, a step of moulding said moulding composition for making a green compact of the article, and then steps of binder removal and sintering to obtain said article in sintered massive cermet.

The present invention also relates to a decorative or covering article in sintered massive cermet, in which said cermet is obtained from an inorganic powder consisting by weight of 35% to 95% of at least one ceramic phase based on ceramic selected from the group consisting of TiC, TiCN, TiN and mixtures thereof, and from 5% to 65% of a metallic phase, said metallic phase consisting by weight of at least 40% of iron, from 15% to 45% of chromium, from 0.1% to 25% of molybdenum, from 0.1% to 10% of silicon, from 0 to 10% of boron, and from 0 to 10% of niobium, the respective amounts of the elements of the metallic phase being such that their sum is equal to 100 wt % of the metallic phase.

The present invention also relates to an element of a clock or watch movement in sintered massive cermet, in which said cermet is obtained from an inorganic powder consisting by weight of 35% to 95% of at least one ceramic phase based on ceramic selected from the group consisting of TiC, TiCN, TiN and mixtures thereof, and from 5% to 65% of a metallic phase, said metallic phase consisting by weight of at least 40% of iron, from 15% to 45% of chromium, from 0.1% to 25% of molybdenum, from 0.1% to 10% of silicon, from 0 to 10% of boron, and from 0 to 10% of niobium, the respective amounts of the elements of the metallic phase being such that their sum is equal to 100 wt % of the metallic phase.

DETAILED DESCRIPTION OF PREFERRED EMBODIMENTS

The powder metallurgy moulding composition according to the invention comprises an inorganic powder intended to form a cermet, and an organic binder.

The organic binder used in the moulding composition according to the invention comprises in a known manner a polymeric structure-forming base of the polyethylene and/or polypropylene type and/or copolymers, waxes of the paraffin type that can be dissolved hot in organic solvents and/or polyethylene glycols that can be dissolved hot in water and at least one organic surfactant of the stearic acid type or stearates. More complex formulations of organic binders giving excellent results may also be used. Such formulations are described for example in international application WO 2014/191304. For making the feedstock, i.e. the hot mixture of organic and inorganic moulding powders, a kneader or a twin-screw extruder will preferably be used. More specifically, a heating kneader with high-speed rotating cutting blades, as described in application EP 2801560, makes it possible to obtain an intimate, homogeneous mixture of the organic and inorganic powders.

Preferably, the moulding composition according to the invention comprises from 4 to 24 wt % of organic binder and 76 to 96 wt % of inorganic powders.

Said inorganic powder consists by weight of 35% to 95% of at least one ceramic phase and from 5% to 65% of a metallic phase, preferably from 50% to 90% of the ceramic phase and from 10% to 50% of the metallic phase, more preferably from 65% to 85% of the ceramic phase and from 15% to 35% of the metallic phase, and more preferably from 70% to 80% of the ceramic phase and from 20% to 30% of the metallic phase.

The ceramic phase of the inorganic powder is based on ceramic selected from the group consisting of TiC, TiCN, TiN and mixtures thereof. Preferably, the ceramic phase is based on TiC or TiN.

In the present description, the expression "ceramic phase based on an element" signifies that said ceramic phase contains at least 50 wt % of said element.

In the present description, all the percentages are indicated by weight. Advantageously, the ceramic phase of the inorganic powder consists by weight of 50% to 100% of a principal ceramic phase based on ceramic selected from the group consisting of TiC, TiCN, TiN, and mixtures thereof, and from 0 to 50% of at least one secondary ceramic phase selected from the group comprising $Cr_3C_2$, CrN, NbC, NbN, TaC, TaN, and mixtures thereof.

Preferably, the ceramic phase of the inorganic powder consists by weight of 80% to 100% of said principal ceramic phase, and from 0 to 20% of said secondary ceramic phase, and more preferably from 90% to 100% of said principal ceramic phase, and from 0 to 10% of said secondary ceramic phase.

Advantageously, said principal ceramic phase of the inorganic powder may consist solely of TiC or consist of TiN, the secondary ceramic phase being NbN (for example 90/10).

According to the invention, the metallic phase of the inorganic powder consists by weight of at least 40% of iron, from 15% to 45% of chromium, from 0.1% to 25% of molybdenum, from 0.1% to 10% of silicon, from 0 to 10% of boron, and from 0 to 10% of niobium, the respective amounts of the elements of the metallic phase being such that their sum is equal to 100 wt % of the metallic phase.

Preferably, the metallic phase of the inorganic powder consists predominantly of iron and chromium, and comprises by weight preferably from 40% to 70% of iron, and more preferably from 45% to 60% of iron, and from 20% to 40% of chromium, and more preferably from 25% to 35% of chromium.

Preferably, the metallic phase of the inorganic powder comprises by weight from 1% to 20% of molybdenum, and more preferably from 5% to 10% of molybdenum.

Preferably, the metallic phase of the inorganic powder comprises by weight from 1% to 10% of silicon, and more preferably from 2% to 8% of silicon.

Preferably, the metallic phase of the inorganic powder comprises by weight from 0% to 5% of boron, and more preferably from 0% to 1% of boron.

Preferably, the metallic phase of the inorganic powder comprises by weight from 0% to 8% of niobium, and more preferably from 0% to 5% of niobium.

The metallic phase according to the invention is therefore an alloy consisting of Fe, Cr, Mo, Si and optionally B and/or Nb.

The preferred contents of the different elements of the metallic phase of the inorganic powder mentioned above may be combined with one another provided their sum is equal to 100 wt % of the metallic phase. If necessary, iron is used for making up the remainder.

Preferably, the metallic phase of the inorganic powder consists of at least 40% of iron (preferably at least 45% of iron), from 25% to 35% of chromium, from 5% to 10% of molybdenum, from 2% to 8% of silicon, from 0% to 1% of boron, and 0% to 5% of niobium, the respective amounts of the elements of the metallic phase being such that their sum is equal to 100 wt % of the metallic phase.

Surprisingly, the combination of Mo and Si in the Fe—Cr metallic phase makes it possible to obtain good corrosion resistance in a saline medium.

Addition of boron and/or niobium to the Fe—Cr—Mo—Si metallic phase makes it possible to increase corrosion resistance in a saline medium. Addition of boron also makes it possible to increase the toughness of the cermet.

Particularly advantageously, the moulding composition of the invention, and in particular the metallic phase does not comprise nickel or cobalt. The metallic phase is also free from manganese and carbon.

The present invention also relates to a method based on powder metallurgy for manufacturing an article in sintered massive cermet comprising a step of preparing a moulding composition as defined above, a step of moulding said moulding composition for making a green compact of the article, and then steps of binder removal and sintering to obtain said article in sintered massive cermet.

More precisely, the step of preparing a moulding composition of the invention comprises weighing the powder of the principal ceramic phase, optionally the powders of the secondary ceramic phases, and the elements making up the metallic phase. The powders are then ground, for example in a ball mill or by attrition, in order to obtain an inorganic powder intended to form the cermet having a homogeneous distribution and comprising particles with average final size of a few microns. The components of the organic binder are then added to obtain the moulding composition according to the invention, traditionally called feedstock. The feedstock may be converted to the form of powder or granules for storage until application of the step of moulding the moulding composition.

This moulding step typically comprises an operation of moulding by pressing or hot injection under pressure in a mould with cavities. A blank or a green compact of the article to be produced is obtained. The green compact is cooled in the cavity and is then ejected from the mould.

The green compact is then submitted to binder expulsion, to remove part of the components of the organic binder, notably the waxes, before the sintering step. A brown compact is obtained.

For the sintering step, the brown compact is put in a furnace at high temperature (for example 1350° C.-1550° C.) to obtain an article in sintered, dense massive cermet.

The method then comprises a step of finishing treatment for the final appearance of the article, by machining (mechanical, laser, water jet, etc.) and/or by polishing.

A method of this kind for manufacture by powder metallurgy is known by a person skilled in the art and does not require further details here.

The article may be a decorative or covering article for watchmaking or jewelry-making or a decorative article of portable equipment, or else an element of a clock or watch movement.

The present invention also relates to a decorative or covering article in sintered massive cermet, notably a decorative or covering article obtained by the method of manufacture by powder metallurgy using the moulding composition described above. The decorative or covering article according to the invention is made of sintered massive cermet, said sintered massive cermet having been obtained from an inorganic powder consisting by weight of 35% to 95% of at least one ceramic phase based on ceramic selected from the group consisting of TiC, TiCN, TiN and mixtures thereof, and from 5% to 65% of a metallic phase, said metallic phase consisting by weight of at least 40% of iron, from 15% to 45% of chromium, from 0.1% to 25% of molybdenum, from 0.1% to 10% of silicon, from 0 to 10% of boron, and from 0 to 10% of niobium, the respective amounts of the elements of the metallic phase being such that their sum is equal to 100 wt % of the metallic phase.

The present invention finally relates to an element of a clock movement in sintered massive cermet, notably an element of a clock movement obtained by the method of manufacture by powder metallurgy using the moulding composition described above. The element of a clock movement according to the invention is made of sintered massive cermet, said sintered massive cermet having been obtained from an inorganic powder consisting by weight of 35% to 95% of at least one ceramic phase based on ceramic selected from the group consisting of TiC, TiCN, TiN and mixtures thereof, and from 5% to 65% of a metallic phase, said metallic phase consisting by weight of at least 40% of iron, from 15% to 45% of chromium, from 0.1% to 25% of molybdenum, from 0.1% to 10% of silicon, from 0 to 10% of boron, and from 0 to 10% of niobium, the respective amounts of the elements of the metallic phase being such that their sum is equal to 100 wt % of the metallic phase.

As the final composition of the sintered massive cermet depends on the sintering parameters used (temperature, duration of the sintering stage, pressure in the sintering chamber), it is preferable here to characterize the decorative or covering article or the element of a clock or watch movement of the invention by the composition of the cermet before sintering.

The moulding composition of the invention makes it possible to obtain, by powder metallurgy, articles in sintered massive cermet, notably decorative or covering articles, free from the allergenic elements traditionally used in cermets, such as nickel or cobalt.

Moreover, the moulding composition of the invention makes it possible to obtain, by powder metallurgy, articles in sintered massive cermet, notably decorative or covering articles or elements of clock movements, with high corrosion resistance in a saline medium, even after undergoing a finishing treatment.

Furthermore, the decorative or covering articles or the elements of clock movements in sintered massive cermet of the invention have a hardness between 1000 and 1800 Vickers, and are therefore particularly resistant to scratching, in a similar way to the cermets used traditionally.

They also have sufficient toughness to be machined and polished easily, similarly to the cermets comprising nickel or cobalt used traditionally.

The various elements used for making the decorative or covering articles of the invention make it possible to obtain sintered massive cermets of low density, i.e. with densities below 10 g/cm$^3$. The decorative or covering articles of the invention therefore have very acceptable wearer comfort, notably in the case of watchmaking articles consisting for example of caps, middles, watch cases or bracelets.

The decorative or covering articles in sintered massive cermet of the invention have an attractive metallic luster after polishing, like the cermets used traditionally.

The decorative or covering articles in sintered massive cermet of the invention have white to grey and greyish pink to pink hues for cermets based on TiC and TiCN, and yellow to yellowish bronze hues for cermets based on TiN.

The decorative or covering articles in sintered massive cermet of the invention are decorative or covering articles for watchmaking or jewelry-making, as well as articles for covering or protecting portable electronics, such as mobile phones and tablets.

The elements of clock or watch movements in sintered massive cermet of the invention are notably functional elements. These elements according to the invention have great hardness and are resistant to corrosion if there is condensation inside the clock or watch movement. Such an element may be a plate, for example. This element is made traditionally from massive brass, in which holes are machined for fitting jewels with a small-diameter hole in their centre for inserting pivots. This brass must then be protected against corrosion with a surface deposit of nickel. A plate made of massive cermet according to the invention, having great hardness, and produced by methods of pressure moulding or by injection according to the method of manufacture of the invention, allows direct insertion of the pivots, without press-fitting or the use of jewels, and does not require surface treatment for corrosion protection.

The present invention will now be illustrated in more detail with the following non-limiting examples.

Examples 1 to 10

Articles are produced in sintered massive cermet starting from moulding compositions comprising the various inorganic powders shown in Table I below, and, as organic binder, a binder comprising a polyethylene, a paraffin wax that dissolves in hot heptane, ethanol or isopropanol as the structure-forming organic constituent, and stearic acid as surfactant.

The inorganic powders comprise, by weight in each case, 70% of a ceramic phase consisting of 100% TiC and 30% of a metallic phase nominally comprising by weight at least iron and 28% of chromium before sintering.

For comparison, various articles are made for which the Fe—Cr metallic phase does not contain molybdenum or silicon (examples 1 to 9).

An article according to the invention is made in the same way, in which the Fe—Cr metallic phase contains both molybdenum and silicon (example 10).

The articles are obtained by the following method:

- grinding the mixture of the powders of the ceramic phase and of the metallic phase in a ball mill, giving a significant reduction in particle size while ensuring good homogeneity of the mixture after grinding, to constitute the inorganic powder
- preparing the mixture of the organic binder and inorganic powder by hot kneading preferably using a kneader with high-speed cutting blades
- injection moulding of 3D pieces for obtaining green compacts ("green bodies")
- hot dewaxing of the green compacts in heptane at 70° C. for 24 h to dissolve the paraffin and a fraction of the surfactant present in the organic binder
- thermal binder removal at a temperature of at least 600° C. of the structure-forming organic compound of the polyethylene type and of the residues of surfactant to obtain a brown compact ("brown body")
- sintering the brown compact under inert gas (argon) at a temperature of at least 1450° C. in order to obtain a dense sintered massive cermet.

The crude articles from sintering are then machined and polished mechanically or in bulk to obtain the final components.

Hardness, toughness, porosity and corrosion resistance are measured for each of the articles in examples 1 to 10.

Hardness is measured using a Wolpert durometer equipped with a Vickers tip (square-base pyramid), at an applied load of 30 kg. It is calibrated beforehand on a reference standard with hardness comparable to that of the cermets.

The hardness must be between 1000 and 1800 Vickers.

For the measurements of toughness, the latter is extrapolated from the size of the cracks that develop at the four corners of the hardness indentation.

The toughness value represents the capacity of a material to resist crack propagation after impact. For the ceramics used traditionally as decoration in watchmaking such as zirconia, notably for making a watch case, it is considered that the toughness measured with Vickers indentations must be at least 4.5 $MPa \cdot m^{1/2}$.

Porosity is estimated using image acquisition software, allowing discrimination of the different contrast zones on a polished surface, at a magnification of 100×. The porosity that is measured is therefore surface porosity. Low porosity is linked directly to good quality and attractive luster of the surface after polishing.

Corrosion resistance is measured using a certified salt spray chamber (ASCOTT S120XP), in which the sample is placed in an inclined position and is then subjected to salt spray (5% NaCl) for 72 h, at a temperature of 35° C.

The results obtained are presented in Table I below:

TABLE I

| Ex. | Composition of the inorganic powder before sintering | Hardness ($HV_{30}$) | Toughness ($MPa \cdot m^{1/2}$) | Porosity (%) | Corrosion resistance |
|---|---|---|---|---|---|
| 1 | 70TiC—FeCr28 | 1487 | 9.2 | 0.08 | low |
| 2 | 70TiC—FeCr28Mo16 | 1612 | 7.4 | 0.17 | low |
| 3 | 70TiC—FeCr28Mo12 | 1593 | 7.3 | 0.14 | low |
| 4 | 70TiC—FeCr28Mo8 | 1578 | 8.6 | 0.09 | low |
| 5 | 70TiC—FeCr28Mo4 | 1555 | 9.0 | 0.53 | low |
| 6 | 70TiC—FeCr28Si1 | 1486 | 8.1 | 0.34 | low |
| 7 | 70TiC—FeCr28Si2 | 1396 | 8.5 | 0.10 | low |
| 8 | 70TiC—FeCr28Si3 | 1448 | 7.4 | 0.29 | low |
| 9 | 70TiC—FeCr28Si4 | 1362 | 8.1 | 0.12 | low |
| 10 | 70TiC—FeCr28Mo8Si4 | 1481 | 6.1 | 0.13 | good |

The results in Table I show that only the moulding composition according to the invention (Example 10) comprising an Fe—Cr—Mo—Si metallic phase allows an article to be obtained in sintered massive cermet, without nickel or cobalt, having good corrosion resistance in a saline medium. The comparative examples (Examples 1 to 9), without Mo or without Si, only have low corrosion resistance in a saline medium.

Examples 11-13

Articles according to the invention are produced by the method in examples 1 to 10. The inorganic powders comprise, by weight in each case, 70% of a ceramic phase consisting of 100% TiC and 30% of a metallic phase nominally consisting, by weight, of iron, 28% of chromium, 8% of molybdenum, 4% of silicon and from 0.2% to 0.6% of boron before sintering.

The same measurements are performed as in examples 1 to 10.

The results are presented in Table II below:

TABLE II

| Ex. | Composition of the inorganic powder before sintering | Hardness ($HV_{30}$) | Toughness ($MPa \cdot m^{1/2}$) | Porosity (%) | Corrosion resistance |
|---|---|---|---|---|---|
| 11 | 70TiC—FeCr28Mo8Si4B0.2 | 1441 | 7.2 | 1.58 | Very good |
| 12 | 70TiC—FeCr28Mo8Si4B0.4 | 1444 | 7.7 | 3.01 | Very good |
| 13 | 70TiC—FeCr28Mo8Si4B0.6 | 1422 | 7.9 | 1.55 | Very good |

Examples 11 to 13 of the invention show that addition of a small amount of boron makes it possible to increase the corrosion resistance in a saline medium. Furthermore, addition of boron makes it possible to increase the toughness. Thus, the measured toughness of 6.1 $MPa \cdot m^{1/2}$ in example 10 of the invention, without boron, increases to the maximum value of 7.9 $MPa \cdot m^{1/2}$ for example 13 of the invention, comprising a nominal amount by weight of 0.6% of boron.

Example 14

An article according to the invention is produced by the method in examples 1 to 10. The inorganic powder comprises, by weight, 75% of a ceramic phase consisting of 100% TiC and 25% of a metallic phase nominally consisting, by weight, of 49.6% of iron, 34% of chromium, 8% of molybdenum, 4% of silicon, 4% of niobium and 0.4% of boron before sintering.

The same measurements are performed as for examples 1 to 10.

The results are presented in Table III below:

TABLE III

| Ex. | Composition of the inorganic powder before sintering | Hardness ($HV_{30}$) | Toughness ($MPa \cdot m^{1/2}$) | Porosity (%) | Corrosion resistance |
|---|---|---|---|---|---|
| 14 | 75TiC—FeCr34Mo8Si4Nb4B0.4 | 1528 | 6.4 | 0.39 | Very good |

Example 14 of the invention shows that addition of niobium also makes it possible to increase corrosion resistance in a saline medium. Furthermore, addition of niobium can improve the homogeneity of the metallic phase and thus reduce the porosity and increase the hardness of the cermet obtained.

Example 15

An article according to the invention is produced by the method in examples 1 to 10. The inorganic powder comprises, by weight, 80% of a ceramic phase nominally consisting, by weight, of 90% of TiN (principal ceramic phase) and 10% of NbN (secondary ceramic phase), and 20% of a metallic phase nominally consisting, by weight, of 59% of iron, 28% of chromium, 8% of molybdenum, and 5% of silicon, before sintering.

The hardness and corrosion resistance are measured as for examples 1 to 10.

The results are presented in Table IV below:

TABLE IV

| Ex. | Composition of the inorganic powder before sintering | Hardness ($HV_{30}$) | Corrosion resistance |
|---|---|---|---|
| 15 | TiN—10NbN—FeCr28Mo8Si5 | 1108 | good |

Example 15 of the invention, comprising a TiN principal ceramic phase and an NbN secondary ceramic phase, as well as an Fe—Cr—Mo—Si metallic phase, has good corrosion resistance in a saline medium.

The article in sintered massive cermet obtained has a metallic luster after polishing with a "bronze" yellow hue with colorimetry indices L*=74.1, a*=5.1, b*=20.2 measured using a Konica Minolta CM-3610 spectrophotometer for performing colorimetry measurements by reflectance in the L*a*b reference space. Before each measurement, calibration is effected on a reference sample, and then three measurements are carried out consecutively.

What is claimed is:

1. A powder metallurgy moulding composition intended for manufacturing articles in sintered massive cermet, comprising an inorganic powder intended to form the cermet and an organic binder, wherein the inorganic powder consists by weight of 35% to 95% of at least one ceramic phase based on ceramic selected from the group consisting of TiC, TiCN, TiN, and mixtures thereof, and from 5% to 65% of a metallic phase, the metallic phase consisting by weight of at least 40% of iron, from 25% to 45% of chromium, from 0.1% to 25% of molybdenum, from 0.1% to 10% of silicon, from 0 to 10% of boron, and from 0 to 10% of niobium, the respective amounts of the elements of the metallic phase being such that their sum is equal to 100 w&% of the metallic phase.

2. The moulding composition according to claim 1, wherein the metallic phase comprises by weight from 40% to 70% of iron.

3. The moulding composition according to claim 2, wherein the metallic phase comprises by weight from 45% to 60% of iron.

4. The moulding composition according to claim 1, wherein the metallic phase comprises by weight from 25% to 40% of chromium.

5. The moulding composition according to claim 4, wherein the metallic phase comprises by weight from 25% to 35% of chromium.

6. The moulding composition according to claim 1, wherein the metallic phase comprises by weight from 1% to 20% of molybdenum.

7. The moulding composition according to claim 6, wherein the metallic phase comprises by weight from 5% to 10% of molybdenum.

8. The moulding composition according to claim 1, wherein the metallic phase comprises by weight from 1% to 10% of silicon.

9. The moulding composition according to claim 8, wherein the metallic phase comprises by weight from 2% to 8% of silicon.

10. The moulding composition according to claim 1, wherein the metallic phase comprises by weight from 0% to 5% of boron.

11. The moulding composition according to claim 10, wherein the metallic phase comprises by weight from 0% to 1% of boron.

12. The moulding composition according to claim 1, wherein the metallic phase comprises by weight from 0% to 8% of niobium.

13. The moulding composition according to claim 12, wherein the metallic phase comprises by weight from 0% to 5% of niobium.

14. The moulding composition according to claim 1, wherein the ceramic phase consists by weight of 50% to 100% of a principal ceramic phase based on ceramic selected from the group consisting of TiC, TiCN, TiN, and mixtures thereof, and from 0 to 50% of at least one secondary ceramic phase selected from the group consisting of $Cr_3C_2$, CrN, NbC, NbN, TaC, TaN, and mixtures thereof.

15. The moulding composition according to claim 1, wherein said inorganic powder consists by weight of 50% to 90% of the ceramic phase and from 10% to 50% of the metallic phase.

16. The moulding composition according to claim 15, wherein said inorganic powder consists by weight of 65% to 85% of the ceramic phase and from 15% to 35% of the metallic phase.

17. The moulding composition according to claim 1, wherein it comprises by weight from 76% to 96% of inorganic powder and from 4% to 24% of organic binder.

18. The moulding composition according to claim 1, wherein the ceramic phase consists by weight of 50% to 90% of a principal ceramic phase based on ceramic selected from the group consisting of TiC, TiCN, TiN, and mixtures thereof, and from 10 to 50% of at least one secondary ceramic phase selected from the group consisting of NbC, TaC, and mixtures thereof.

19. A method based on powder metallurgy for manufacturing an article in sintered massive cermet comprising a step of preparing a moulding composition according to claim 1, a step of moulding said moulding composition for making a green compact of the article, and then steps of binder removal and sintering to obtain said article in sintered massive cermet.

20. The method based on powder metallurgy for manufacturing an article in sintered massive cermet according to claim 19, wherein said article is a decorative or covering article.

21. The method based on powder metallurgy for manufacturing an article in sintered massive cermet according to claim 19, wherein said article is an element of a clock or watch movement.

* * * * *